US005795661A

United States Patent [19]

Taffinger

[11] Patent Number: 5,795,661

[45] Date of Patent: Aug. 18, 1998

[54] ZINC COATED STEEL SHEET AND STRIP HAVING IMPROVED FORMABILITY AND SURFACE QUALITY AND METHOD THEREOF

[75] Inventor: Berta M. Taffinger, Stroudsburg, Pa.

[73] Assignee: Bethlehem Steel Corporation

[21] Appl. No.: 677,746

[22] Filed: Jul. 10, 1996

[51] Int. Cl.[6] ..... B32B 5/16; C23C 22/00

[52] U.S. Cl. ..... 428/628; 428/659; 148/246; 148/252; 427/327; 427/334

[58] Field of Search ..... 428/659, 341, 428/621, 628; 427/327, 334; 148/246, 252

[56] References Cited

U.S. PATENT DOCUMENTS

| | | | |
|---|---|---|---|
| 1,493,012 | 5/1924 | Abraham | 148/252 |
| 2,045,154 | 5/1936 | Heussner | 148/6 |
| 2,046,061 | 6/1936 | Curtin et al. | 148/6.5 |
| 2,060,365 | 11/1936 | Curtin | 148/6 |
| 2,066,842 | 1/1937 | Lodeesen | 148/6 |
| 2,081,449 | 5/1937 | Cook | 148/6.5 |
| 2,105,015 | 1/1938 | Singer | 148/4 |
| 2,577,887 | 12/1951 | Gibson | 148/6.14 |
| 2,617,749 | 11/1952 | Gibson | 148/6.24 |
| 2,669,532 | 2/1954 | Gibson | 148/6.14 |
| 2,800,421 | 7/1957 | Goodspeed et al. | 148/6.14 |
| 2,835,616 | 5/1958 | Rausch et al. | 148/6.14 |
| 3,459,604 | 8/1969 | Freeman et al. | 148/6.24 |
| 3,519,495 | 7/1970 | Plaxton | 148/6.16 |
| 3,573,997 | 4/1971 | Plaxton | 148/6.16 |
| 3,632,452 | 1/1972 | Matsumura | 148/6.14 |
| 4,086,176 | 4/1978 | Ericson | 252/100 |
| 4,316,752 | 2/1982 | Kronstein | 148/6.16 |

*Primary Examiner*—Paul J. Thibodeau
*Assistant Examiner*—Holly C. Rickman
*Attorney, Agent, or Firm*—Harold I. Masteller, Jr.

[57] ABSTRACT

A method for improving the formability of zinc coated steel sheet, and the product produced therefrom. The steps of the method include applying to the zinc coating an oxalic acid solution in an amount that will form a zinc oxalate film having a coating weight in a range of s about 10 mg/ft$^2$ to about 100 mg/ft$^2$. A lubricant is applied to the zinc oxalate film, and the lubricant is adsorbed by the zinc oxalate film to provide a lubricated zinc oxalate film that is bonded to the zinc coating. The method produces an improved zinc coated sheet product having a tightly formed lubricated coating structure resistant to galling in the die steels of a forming press. The improved zinc coated sheet product having a lubricated zinc oxalate film improves formability and reduces the coefficient of friction during the forming operations that shape the zinc coated steel sheet or strip into a finished product shape.

18 Claims, 11 Drawing Sheets

ZINC COATED STEEL SHEET AND STRIP HAVING IMPROVED FORMABILITY AND SURFACE QUALITY AND METHOD THEREOF

BACKGROUND OF THE INVENTION

This invention is directed to a method for improving the formability and surface quality of zinc coated steel sheet and strip, and in particular, this invention is directed to improving the formability and surface quality of galvannealed steel sheet and strip products by reducing the coefficient of friction. Zinc coated steel sheet and strip is used to manufacture a variety of different automotive components. For example, on the one hand, hot-dip galvanized steel sheet and strip is used to form portions of the automobile where surface appearance is not important such as the underbody, door beams and trunk interiors. On the other hand, because of their high surface quality appearance, zinc alloy coated steel sheet and strip products such as galvanneal tend to be used throughout the exterior portions of automobiles such as doors, hoods and deck lids, where a high gloss painted finish is important.

Zinc coated steel sheet and strip products enjoy a major share of the automotive market because they have excellent resistance to corrosion and mechanical damage. However the galvannealed coatings are viewed, in some instances, as being unfavorable with respect to their formability when compared to other zinc alloy coatings such as ZnNi coated steel sheet and strip. This is because during forming operations, the die steel friction generates heat that softens the galvanneal coating on the surface of the steel product. The softened coating tends to deform and gall during the press fonning operations, and the galling action produces a zinc flake buildup within the forming dies of the press. This causes defects in the surface appearance of the finished product. In order to overcome the problem of galling, and in order to maintain good surface quality in the finished product, it is necessary for operators to frequently shut down the forming press to clean and remove the zinc flake buildup from the dies.

The difficulties encountered when forming zinc coated products is well known within the steelmaking industry. In the past, there have been various attempts to improve both the formability as well as the finished surface quality of such zinc coated products. One solution is to lubricate the zinc coating with a mill oil. The lubricant reduces the coefficient of friction (COF), and also provides a barrier between the zinc coating and the die steels of the press. As a result, the COF is reduced by the application of the mill oil and less heat is generated during the forming operation. There is also less direct contact between the die steels and the zinc coating because the lubricant acts as a separation layer between the zinc coating on the steel blank and the die steels of the press. The lower forming temperatures and the reduced die/product contact causes a decrease in galling and an increase in surface quality of the finished formed product. Various substances such as soaps, waxes and machining oils have been used in the past as lubricants in forming operations. However, these lubricants are easily wiped into the die steels during the press forming operations. As a result, the ensuing buildup of lubricant within the forming dies causes elevated hydrostatic pressures that adversely effect the forming process as well as the quality of the finished formed product. Therefore, it is necessary for manufacturers to select and apply lubricants that have a high viscosity that will resist the wiping action of the moving die steels. However, such thick oils and lubricants make the blanks extremely difficult to handle throughout the manufacturing process, and in some instances, the thick oils leave deposits that cause hazardous working conditions.

SUMMARY OF THE INVENTION

It is therefore the object of this invention to provide zinc coated steel sheet or strip having a surface coating that improves formability properties and improves frictional properties, e.g. COF.

It is a further object of this invention to provide zinc coated steel sheet or strip having a surface coating that improves resistance to galling during forming operations.

It is a further object of this invention to provide zinc coated steel sheet or strip having a surface coating that provides a separation layer resistant to wiping into forming dies.

It is still a further object of this invention to provide zinc coated steel sheet or strip having a surface coating that preserves weldability, phosphatability, and compatibility with state of the art manufacturing line operations.

I have discovered that the foregoing objects can be attained by a method for improving the formability of zinc coated steel sheet, and the product produced therefrom. The steps of the method include applying to the zinc coating an oxalic acid solution in an amount that will form a zinc oxalate film having a coating weight in a range of about 10 $mg/ft^2$ to about 100 $mg/ft^2$. A lubricant is then applied to the zinc oxalate film, and the lubricant is adsorbed by the zinc oxalate film to provide a lubricated zinc oxalate film that is bonded to the zinc coating. The method produces an improved zinc coated sheet product having a tightly formed lubricated coating structure resistant to galling in the die steels of a forming press. The improved zinc coated sheet product having a lubricated zinc oxalate film improves formability and reduces the coefficient of friction during the forming operations that shape the zinc coated steel sheet or strip into a finished product shape.

DETAILED DESCRIPTION OF THE PREFERRED EMBODIMENT

The automotive industry is a large consumer of various zinc coated steel sheet and strip products. A typical car body assembly line includes forming zinc coated steel sheet into the various car body components, assembling the various components into a completed car body, dipping or immersing the completed car body into a phosphating bath prior to painting, and finally, painting all the exposed surfaces of the phosphated sheet steel including applying and baking a high-gloss finish on the exterior finish surfaces of the automobile.

The present invention is directed to the very beginning of the automotive assembly line where the zinc coated steel sheet or strip is formed into the various body components of the car. The improved zinc coated steel sheet or strip of the invention enables manufactures to better form and shape the various sheet metal components prior to assembly, phosphating and painting operations. However, it should be understood that although the invention is described as being suited for the manufacture of automobiles, it is equally suited for the manufacture of any formed product made from zinc coated steel sheet or strip such as appliances, furniture, residential and commercial building components including steel framing, doors and windows, etc.

Figure 1:
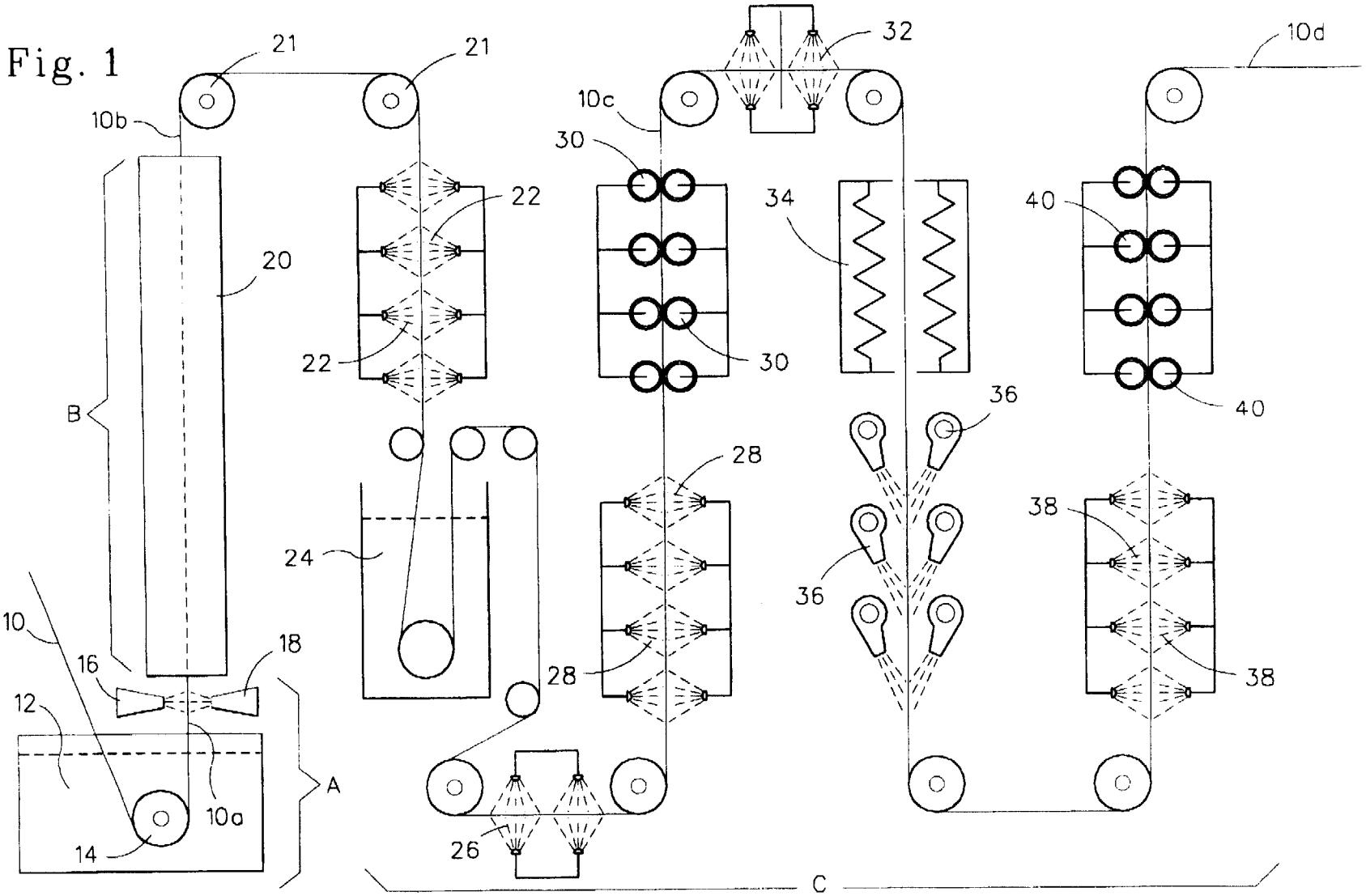
FIG. 1 is a flow diagram showing the steps of the method for improving formability in a zinc coated steel sheet or strip.

As shown in FIG. 1, the preferred embodiment of the present invention comprises a continuous galvannealing line having a hot dip coating portion "A", an annealing portion "B" and a post treatment conversion coating portion "C". The uncoated steel sheet or strip 10 enters the hot dip coating portion "A" where a molten zinc coating is applied thereto in a hot dip bath 12. A sinker roll 14 immerses the uncoated strip 10 into the molten zinc bath 12. The sinker roll orientates the strip vertically to exit the bath between opposed air knives 16 and 18 prior to entering the annealing portion "B" of the continuous galvannealing line. The air knives are disposed on opposite sides of now zinc coated strip 10*a* to direct high pressure wiping jets of gas such as air, nitrogen or steam, against the strip surfaces. The high pressure wiping jets remove excess molten zinc from the strip and evenly disburse the zinc coating along the strip to provide a desired coating thickness. It should be understood, however, that although the preferred embodiment shows a zinc coating being applied to both sides of strip 10, the strip could just as well be zinc coated on only one side without departing from the scope of this invention.

The zinc coated strip moves toward annealing portion "B" and enters furnace 20 where the strip is heated (annealed), to convert the zinc coating into a zinc-alloy coating known as galvanneal. The galvannealed strip 10*b* leaves the annealing furnace 20 and rollers 21 redirect the galvannealed strip toward further processing such as slitting, coiling and the like. In the case of the present invention, the galvannealed strip 10*b* is redirected toward the conversion coating step "C" where a zinc oxalate coating is bonded to the outside surface of the protective galvanneal coating prior to slitting and coiling operations.

Upon entering the conversion coating portion "C" of the continuous galvannealing line, the galvannealed strip 10*b* is cleaned with an alkaline cleaning solution, such as Parco 338 or the like, to prepare the galvannealed surface for bonding with the zinc oxalate film. The alkaline cleaner may be applied to the strip surface by either spraying the strip with the alkaline cleaner as shown at 22, by immersing the strip into an alkaline bath as shown at 24, or by any other well known means in the art. The alkaline cleaner is applied to the surface of the galvannealed strip at a temperature of about 140° F. for about 1 second up to about 60 seconds. After the cleaning step, the strip is spray rinsed with water as shown at 26 to remove any residual alkaline cleaner left behind from the cleaning step. The water rinse may be applied by spraying as shown, or by any other suitable means known in the art.

Although the preferred embodiment shows applying an alkaline cleaner to the zinc coated sheet or strip prior to bonding the zinc oxalate film to the zinc coated surface of the steel substrate, it should be understood that the alkaline cleaning step may be omitted without departing from the scope of this invention. As discussed in more detail later, it has been discovered that a zinc oxalate film may be formed on the surface of zinc coated steel sheet and strip where the alkaline cleaning step has been omitted and still obtain at least acceptable improved forming properties.

After rinsing with water, an oxalic acid solution is applied to the cleaned galvanneal surface by either spraying as shown at 28, by rolling as shown at 30, or by any other means known in the art. Once again, the preferred means for applying the oxalic acid solution is spraying. The oxalic acid solution reacts with the galvannealed coating on strip 10*b* to form a zinc oxalate film that chemically bonds to the galvannealed surface on the steel sheet. The oxalic acid solution is applied to the strip at a temperature of about 21° to 24° C., for about 2 seconds to about 30 seconds with a preferred treatment range of about 2 seconds to about 5 seconds. The solution comprises about 7 to 14 grams per liter of oxalic acid to about 2 to 4 grams per liter of hydrogen peroxide, with a preferred solution of about 10 grams per liter of oxalic acid to about 3.3 grams per liter of hydrogen peroxide. Measurements have shown that the preferred oxalic acid solution forms a zinc oxalate film having a weight in the range of about 10 milligrams to 100 milligrams per square foot.

The treated sheet 10*c*, on which the zinc oxalate film has been bonded to the surface of the galvanneal coating, is rinsed with water 32 to remove any remaining oxalic acid solution. As before, the water rinse 32 may be applied by either spraying or by any other suitable means, the preferred method being spraying. The strip is then dried in an oven 34 at a temperature of about 140° F. or lower, or hot air dried at the same temperature as shown at 36.

A mill oil lubricant, such as Quaker 61 AUS mill oil or the like, is applied to the surface of the zinc oxalate film after the drying step is completed. The lubricant is applied at a rate of about 300 mg/ft$^2$, and it may be applied by either spraying as shown at 38, by a mechanical means such as the applicator rolls shown at 40, or by any other suitable means well known in the industry. The lubricant is adsorbed by the zinc oxalate film, and it adheres to the surface of the zinc oxalate film in an extremely thin layer of molecules that resist wiping during the handling and forming operations. The above conversion coating treatment produces a zinc coated steel sheet or strip product having a lubricant affixed to the surface of a zinc oxalate film that is chemically bonded to the surface of a zinc coated steel sheet or strip. This tightly formed coating structure provides a lubricated separation layer that is positioned between the protective zinc coating on the steel substrate and the die steels in the forming press. The zinc oxalate separation layer resists wiping from the product surface during the forming operation because it is chemically bonded to the zinc coating on the steel. The lubricant resists wiping from the coated surface because it is adsorbed into the zinc oxalate separation layer that is chemically bonded to the zinc coating. The adhering lubricant reduces the COF during press forming, and as a result of the reduced COF, sheet formability is improved and less heat is generated. The lower forming temperatures reduce galling because there is less heat to soften the zinc coating, and the surface quality of finished zinc coated sheet product is improved. And finally, because only a thin layer of lubricant molecules adhere to the zinc oxalate film that is bonded to the protective zinc coating, the zinc coated steel blanks of the present invention are easily handled on the assembly line, and leave no oily deposits that are considered hazardous to the work area.

The process and improved formability properties of the present invention will be further illustrated by the examples set forth below.

EXAMPLE 1

Steel sheet samples having a galvanneal coating on two sides and a coating weight of 60 g/m$^2$ were spray cleaned with Parco 338, an alkaline spray cleaner, to remove any grease or dirt from the surface of the coating. The cleaned galvannealed samples were then rinsed with water and a 5 second spray treatment was applied to the surface of the galvanneal coating. The solution comprised 10 g/l of oxalic acid to 3.3 g/l of hydrogen peroxide. The oxalic acid spray treatment produced a zinc oxalate film having a thickness by weight in the range of about 70 to about 100 mg/ft$^2$. The zinc oxalate film chemically bonded to the surface of the galvanneal coating, and its chemistry was determined to be zinc oxalate by X-ray Diffraction. Mill oil was then applied to both sides of the treated sample sheets at a rate of 300 mg/ft$^2$ of 61 AUS mill oil. The samples were tested for coefficient of friction (COF), and for quantitative forming characteristics as determined by Limiting Dome Height (LDH), values. The Limiting Dome Height (LDH) Test is a mechanical test in which a coated or uncoated sheet steel sample is subjected to substantial stretching, accompanied by some sliding, over a 4 inch hemispherical punch face to simulate fracture conditions as in a press forming operation. The correlation between the Limiting Dome Height Test and production stamping performance is widely accepted in the steel manufacturing and automotive industries. Initial tests are performed to identify the specimen width that yields a minimum dome height ($LDH_{min.}$), for the specific sheet material being tested. Further tests are then run on sheet material having the same specimen width to determine an $LDH_{min.}$ mean value. An increase in the mean $LDH_{min.}$ value relative to the control sheet $LDH_{min.}$ is correlative with improved production stamping performance, and accordingly, improved formability as shown in the Tables "A" and "B" below. The oxalate treated galvannealed sheet demonstrated improved performance in formability and reduced COF when compared with untreated control galvanneal sample shown in Table A below.

TABLE A

| PROPERTY | EXAMPLE 1 | EXAMPLE 2 | CONTROL (UNTREATED) |
|---|---|---|---|
| Oxalate Film Wt. mg/ft$^2$ | 70 to 100 | 30 to 60 | 0 |
| LDH minimum inches | 1.442 | 1.407 | 1.310 |
| COF | 0.110 | 0.126 | 0.159 |

EXAMPLE 2

Steel sheet samples having a galvanneal coating on two sides and a coating weight of 60 g/m$^2$ were prepared for testing. In this example the samples were not pre-cleaned with the alkaline cleaner as described in Example 1. However, the samples were degreased with an organic solvent prior to oxalation. The uncleaned samples received a 5 second spray treatment with the same oxalic acid solution comprising 10 g/l of oxalic acid to 3.3 g/l of hydrogen peroxide. The oxalate spray treatments on the uncleaned samples produced a zinc oxalate film that was chemically bonded to the surface of the galvanneal coating, the zinc oxalate film having a thickness by weight in the range of about 30 to about 60 mg/ft$^2$. Quaker 61 AUS mill oil was applied to both sides of the treated sample sheets at a rate of 300 mg/ft$^2$, and the samples were tested for COF and LDH values. The uncleaned, oxalate treated galvannealed sheet demonstrated improved performance in formability and reduced COF when compared with the untreated control galvanneal sample as shown in Table A.

The zinc oxalate coating weights shown in Table A, as well as the zinc oxalate coating weights shown in Table B, were determined by using a weigh-strip-weigh process where 20 g/l of ammonium dichromate in concentrated ammonium hydroxide was used as a stripping solution prior to final weighing of the tested samples.

EXAMPLE 3

Additional steel sheet samples taken from the same galvanneal coil as used for Examples 1 and 2. These samples were tested to establish criticality between the time duration of the oxalate spray treatment and the resulting zinc oxalate coating weight formed by the oxalate spray treatment. The test was also performed to establish whether washing with an alkali cleaner prior to the oxalic acid treatment had any effect on the formability properties of the galvanneal samples. Where the galvanneal samples were pre-washed with an alkaline solution, Parco 338 alkaline spray cleaner was used. The cleaned zinc coated steel sheet samples were then rinsed with water followed by a spray treatment with an oxalic acid solution containing 10 g/l of oxalic acid to 3.3 g/l of hydrogen peroxide. As shown in Table B, different oxalic acid spray treatment times ranging from 2 seconds up to 30 seconds produced different coating weights in the zinc oxalate film that chemically bonded itself to the surface of the galvanneal coating on the steel substrate. As disclosed in Examples 1 and 2, 300 mg/ft$^2$ of mill oil was applied to both sides of the treated sample sheets before the samples were tested for COF and LDH values.

TABLE B

Figure 2A:
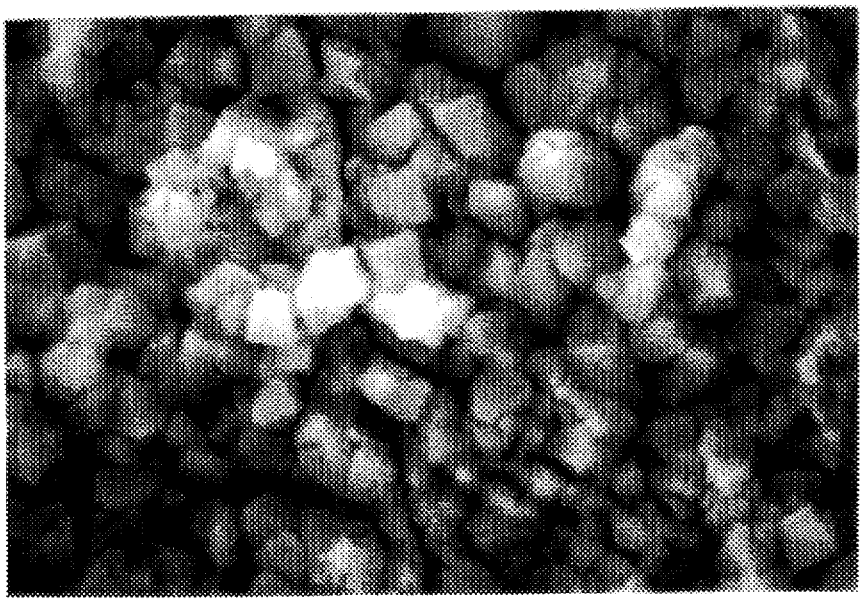
FIGS. 2*a*–2*g* are photomicrographs showing galvanneal test samples listed in Table B of the specification.
Figure 2B:
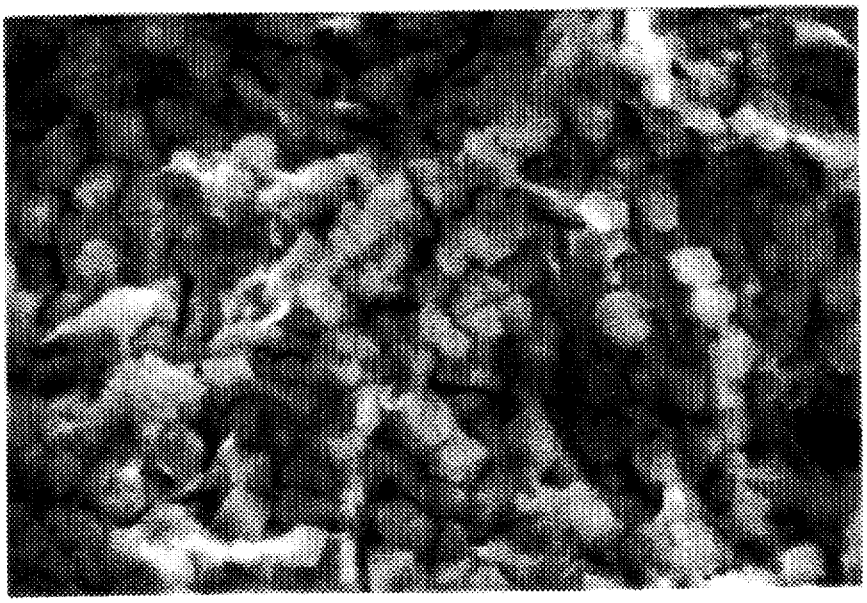
Figure 2C:
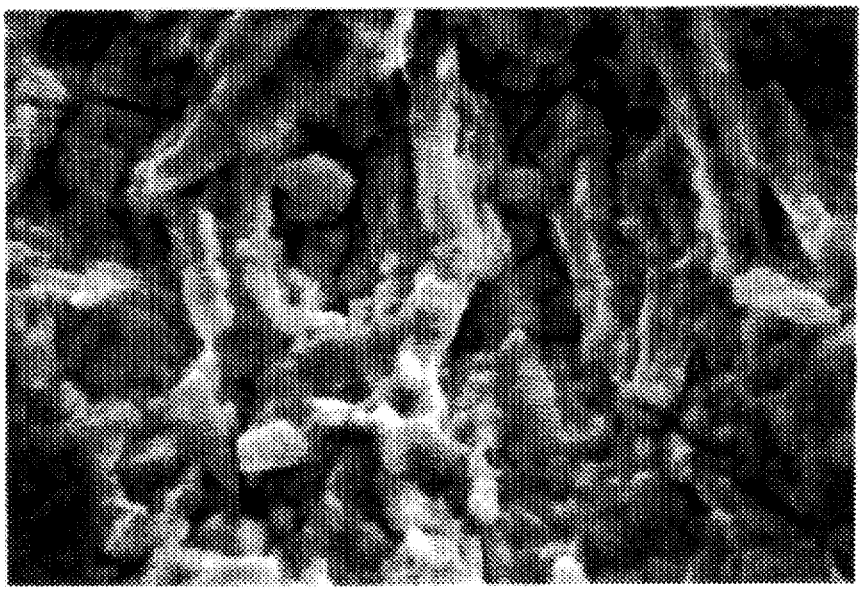

| Oxalic Acid Treatment Seconds | Zinc Oxalate Film Weight mg/ft$^2$ | LDH Minimum Inches | 95% Confidence Limit | Width at LDH min. Inches | COF |
|---|---|---|---|---|---|
| 30 (FIG. 2a) | 240 to 280 | 1.427 | 0.014 | 5.625 | 0.121 |
| 10 (FIG. 2b) | 100 to 140 | 1.438 | 0.004 | 5.625 | 0.116 |
| 5 (FIG. 2c) | 70 to 100 | 1.442 | 0.011 | 5.625 | 0.110 |
| 5* (FIG. 2d) | 30 to 60 | 1.407 | 0.016 | 5.625 | 0.126 |
| 2 (FIG. 2e) | 40 to 70 | 1.422 | 0.013 | 5.625 | 0.112 |
| 2* (FIG. 2f) | 10 to 30 | 1.389 | 0.013 | 5.375 | 0.123 |
| 0 (FIG. 2g) | 0 | 1.310 | 0.012 | 5.500 | 0.159 |

*Without a pre-treatment alkaline wash. All other samples received a pre-treatment wash with Parco 338 alkaline cleaner.

The oxalate spray treated galvannealed sheet demonstrated quantitative improved formability properties when compared with the untreated galvanneal samples. Table B shows that when compared to the values for the untreated galvanneal, the LDH values for the treated galvanneal were improved within a range of about 6% to about 10%, and the COF values were reduced within a range of about 21% to about 31%.

Figure 2D:
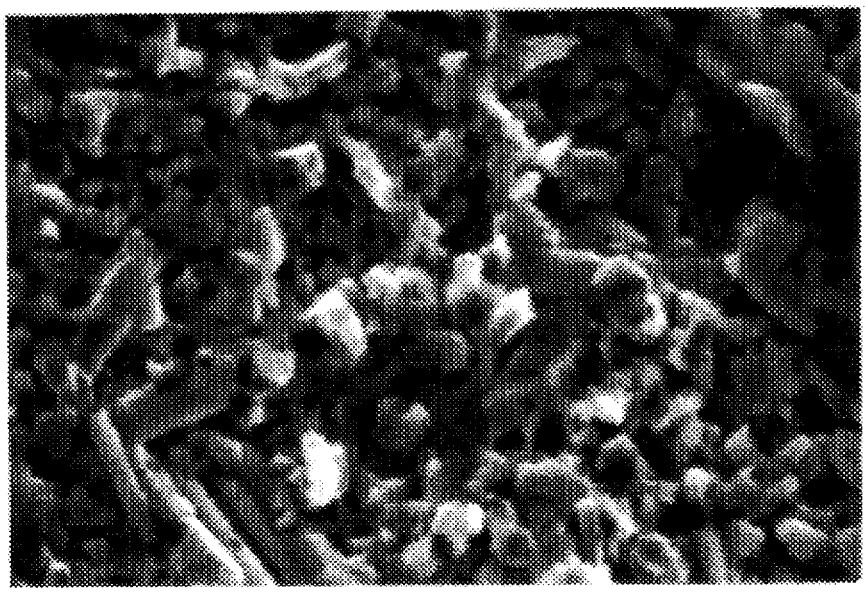
Figure 2E:
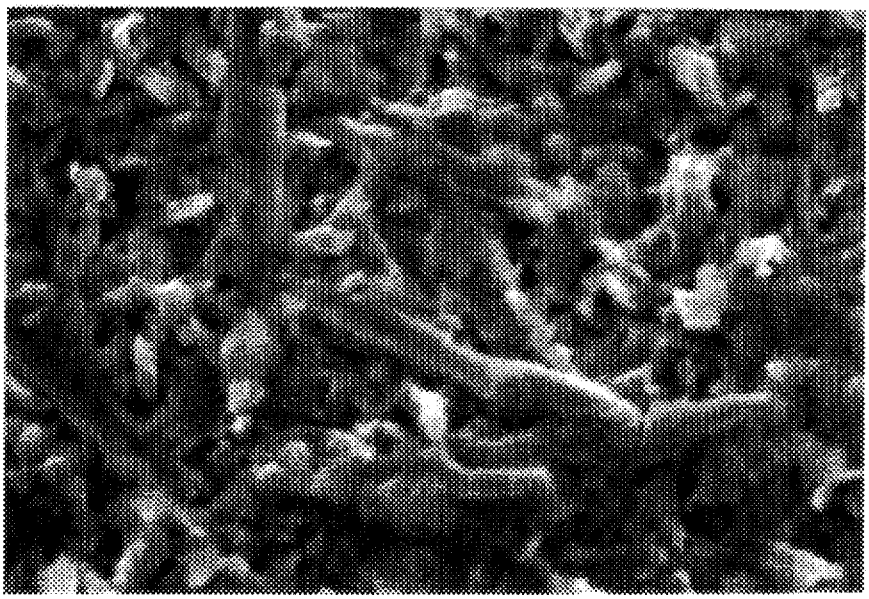
Figure 2F:
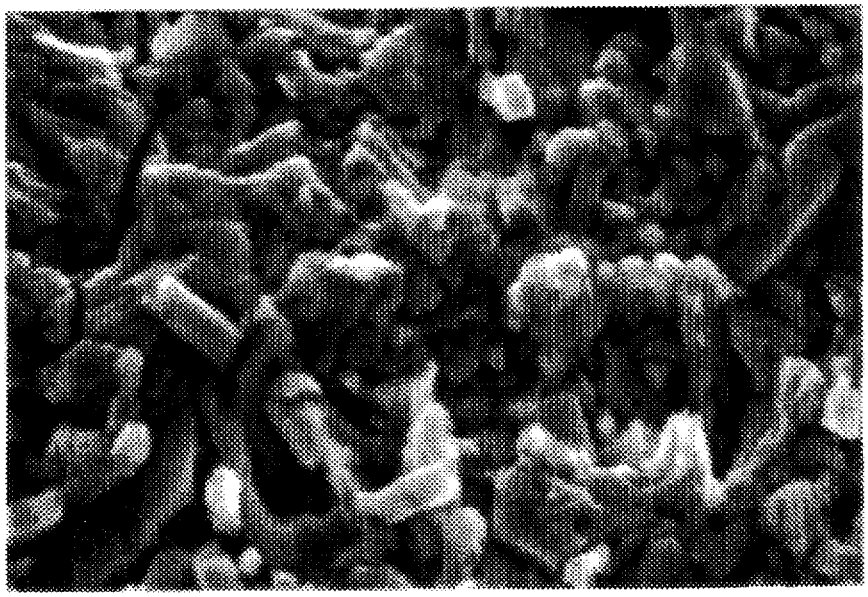
Figure 2G:
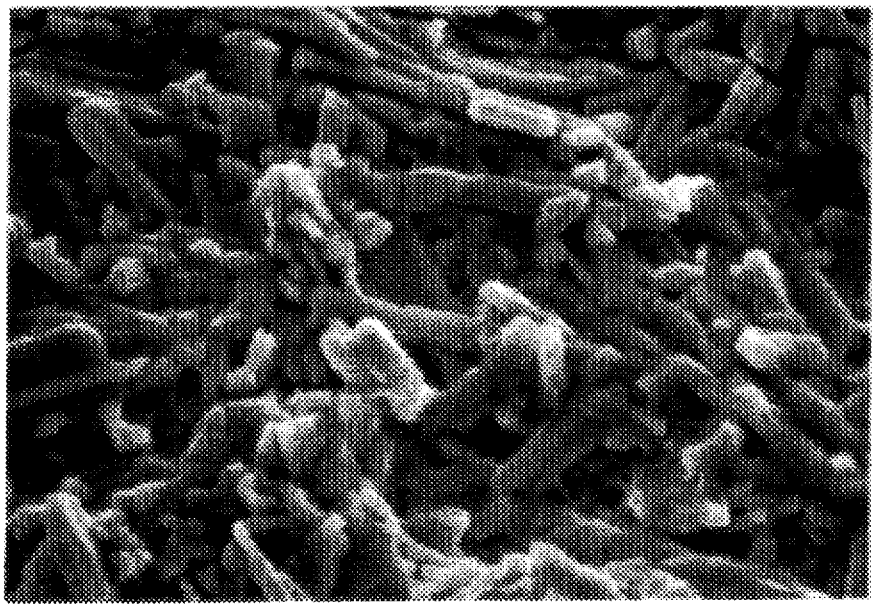

FIGS. 2a–2g show microspecimens taken from the galvanneal samples listed in Table B. FIGS. 2a–2f show the surface morphology after the samples received oxalate spray treatments ranging form 2–30 seconds. FIGS. 2d and 2f show microspecimens that did not receive the pretreatment alkaline cleaning step. The photomicrograph in FIG. 2g shows the surface morphology of an untreated galvanneal control sample that did not receive an oxalate spray treatment. It is easy to visually pick out distinct oxalate crystals in the surface morphology shown in FIGS. 2a and 2b. These specimens received 30 second and 10 second oxalate spray treatments respectively after first receiving the pretreatment alkaline cleaning step. The oxalate crystals appear cubic in shape, having a crystal size of about 1–2 microns. At shorter treatment times, as shown in FIGS. 2c–2f, the samples that received only a 2–5 seconds of oxalate spray treatment, it is very difficult to differentiate distinct oxalate crystal morphology from the galvanneal crystal morphology. At these oxalate treatment times it was necessary to use measurement technology such as Energy Dispersive Spectroscopy (EDS spectrum), Raman Spectroscopy, and X-ray diffraction to confirm the presence of zinc oxalate on the surface of the test samples.

Figure 3A:
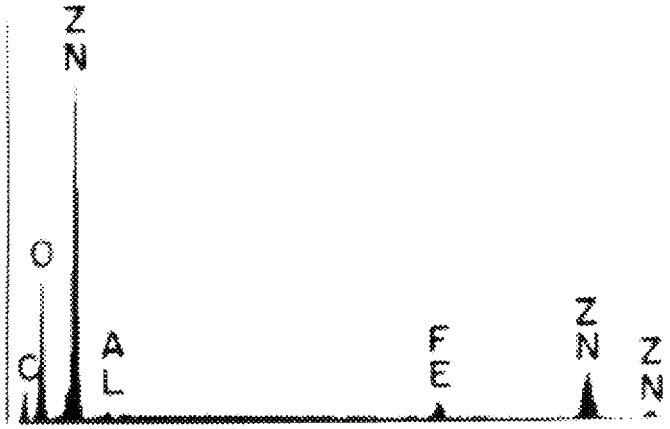
FIGS. 3*a*–3*e* are photographs showing EDS spectra for galvanneal samples listed in Table B of the specification.
Figure 3B:
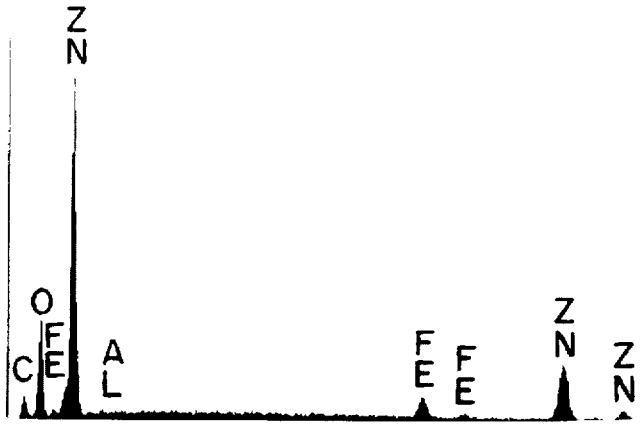
Figure 3C:
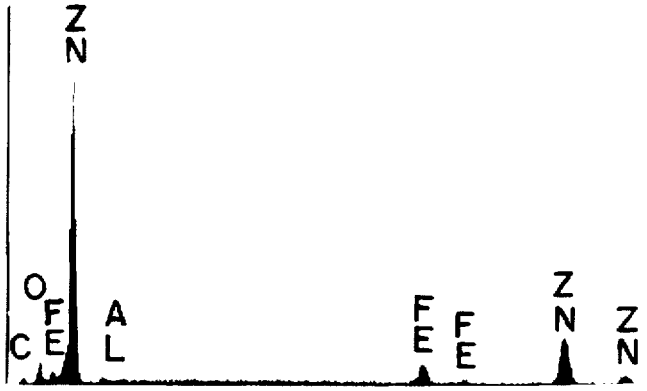
Figure 3D:
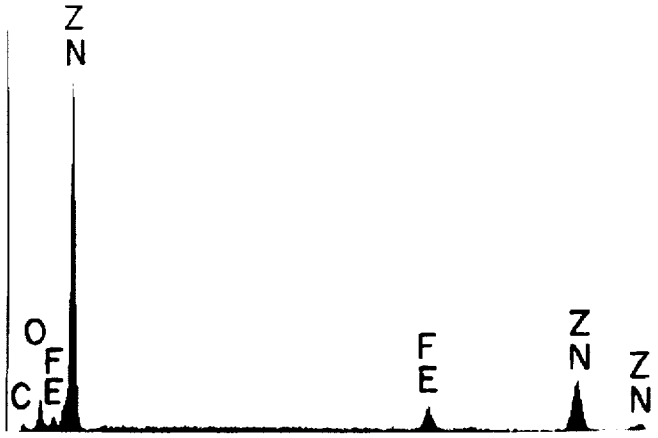
Figure 3E:
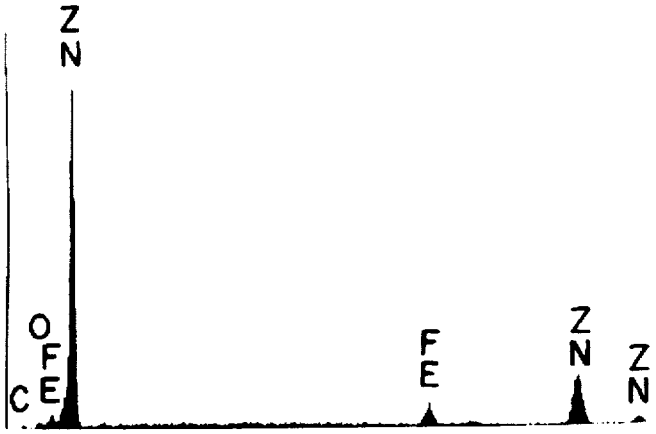

FIGS. 3a–3d show EDS spectra for the galvanneal samples listed in Table B that received from 2 to 30 seconds of oxalate spray treatment. FIG. 3e shows the EDS spectrum for the galvanneal control sample in Table B that did not receive the oxalate spray treatment. FIGS. 3a and 3b show EDS spectra for the samples that received oxalate spray treatment times of 30 and 10 seconds respectively. The EDS spectra show the presence of a relatively thick zinc oxalate coating, indicated by the band marked "O", for both the 30 and 10 second specimens. FIGS. 3c and 3d show EDS spectra for the test samples that received 5 and 2 second spray treatments respectively. As clearly shown by the bands marked "O", the presence of zinc oxalate is detected in the galvanneal samples that received low oxalate treatment times. And finally, FIG. 3e shows the EDS spectrum for a control sample of untreated galvanneal.

Figure 4A:
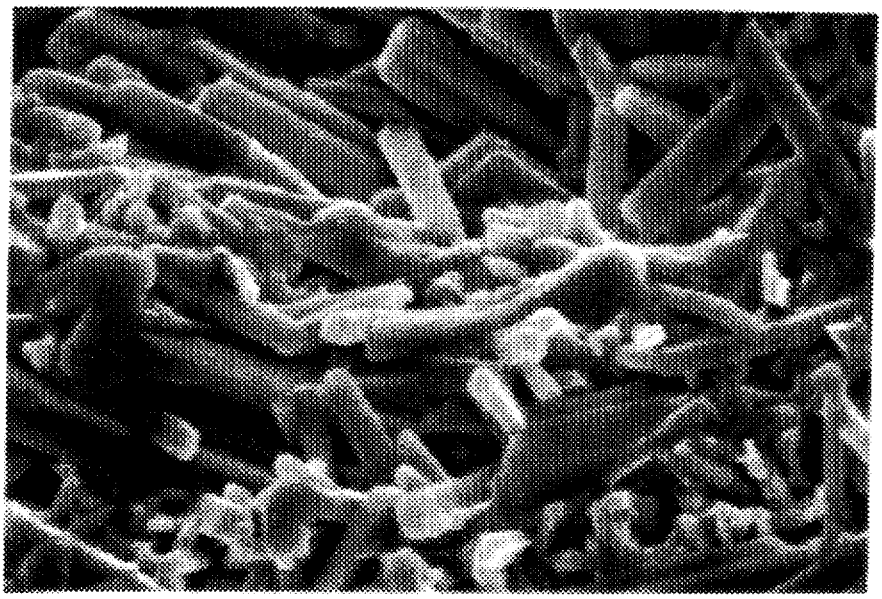
FIGS. 4*a*–4*c* are photomicrographs showing galvanneal samples where zeta phase is present in the galvanneal coating.
Figure 4B:
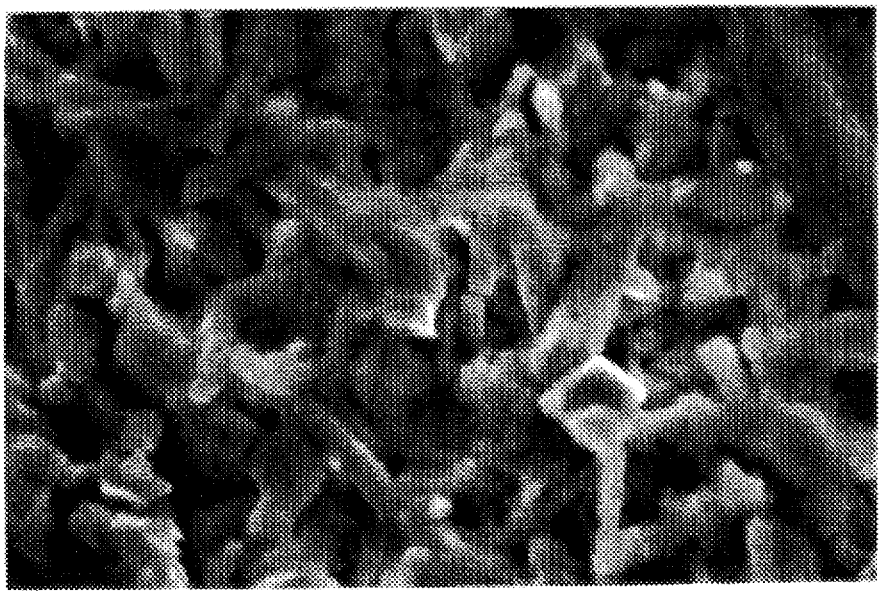
Figure 4C:
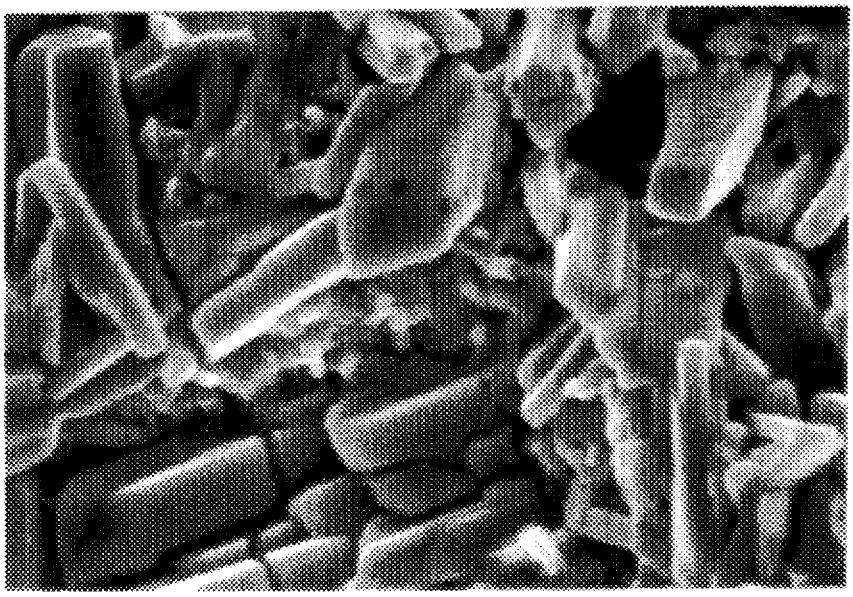

Tables A and B clearly show that oxalate treatment time and pretreatment with an alkaline cleaner have an influence on the zinc oxalate coating weights that are formed on the surface of the galvanneal sheet product. However, it has also been discovered that the zinc oxalate coating weight is also influenced by the phases that are present in a galvanneal coating. For example, in the test samples listed in Table B, X-ray diffraction indicated that delta and gamma phases were present in the galvanneal coating, and also revealed that zeta, delta and gama phases were present in the microspecimens shown in FIGS. 4a–4c. FIG. 4a shows the surface morphology of untreated galvanneal. FIG. 4b shows the surface morphology of galvanneal after receiving a 2 second oxalate spray treatment after a pretreatment cleaning step with an alkaline solution. FIG. 4c shows the surface morphology of galvanneal after receiving a 5 second oxalate spray treatment without first receiving a pretreatment cleaning step. If we compare the microspecimen of FIG. 4b where zeta, delta and gamma phases are present in the galvanneal coating, with the microspecimen shown in FIG. 2e where only delta and gamma phases are present in the galvanneal coating, we see a significant difference between the surface morphology of the two coatings. In FIG. 2e, it is very difficult to visually detect any oxalate crystal morphology. However, in FIG. 4c, where zeta phase is present, the planar faces of the galvanneal crystals are not smooth as seen in FIG. 4a for the untreated galvanneal control specimen. The galvanneal crystals shown in FIG. 4c could be described as being bumpy or "alligator skin-like" in appearance. It is believed that this is a presumptive indication of an early stage of oxalate crystal growth, but distinct and separate oxalate crystal morphology is not detected. It is also believed that at such an abbreviated time, the early crystal growth may result from the synergistic effects of appreciable zeta phase content in the galvanneal coating and pretreatment with an alkaline cleaner. Additionally, if we look at FIG. 4b, where the microspecimen received a 5 second oxalate acid spray treatment without first receiving a pretreatment alkaline cleaning step, visual inspection of this microspecimen fails to detect the presence of oxalate crystals on the surface of the galvanneal coating. The appearance of the galvanneal coating is very similar to the untreated microspecimen shown in FIG. 4a. Therefore, it can be presumed that the pretreatment alkaline cleaning step enhances the reactivity of the galvanneal coating relative to the oxalic acid treatment, and in particular, it enhances the reactivity of a galvanneal coating where zeta phase is present in the coating.

Based upon the above test data in Table A and Table B, the oxalic acid treatment process described in Examples 1–3 clearly reduces the COF and improves the formability properties of zinc coated sheet steel and strip when the steps of the process are carried out in accordance with the steps set forth above in the above examples. As shown in Table B, the LDH is 1.310" and the COF is 0.159 for untreated galvanneal sheet. The test data shows that the LDH can be improved to 1.442" and the COF can be reduced to 0.110 when a pretreatment alkaline cleaning step is followed by a 5 second application of oxalic acid spray treatment. Although the test data shows treatment times as high as up to 30 seconds, it is believed that shorter treatment times of about 2–5 seconds are more suited for use with the pace of today's state of the art high-speed coating lines.

As heretofore explained, after forming zinc coated sheet into a shaped finished product, the finished form is immersed in a phosphating bath to provide a base surface for paint or similar coatings. Tests were conducted to determine whether the oxalate process had a detrimental effect on the phosphatability of the galvanneal product. The tests followed the process steps in the following Example 4.

EXAMPLE 4

Galvanneal sheet specimens having a zinc oxalate film bonded to the surface of the annealed zinc coating were spray cleaned with a different alkaline cleaning solution, Parco 348 cleaner. The alkaline cleaner was applied within a temperature range of about 100°–110° F. for about 90 seconds, and the samples were rinsed in hot tap water for about 30 seconds. The cleaned and rinsed samples were immersed in a surface conditioner, such as Fixodine-Zn or the like, for about 60 seconds at ambient temperature, and a phosphate spray was applied to the galvanneal surface at a temperature range of about 120°–130° F. for a time period of about 60 seconds. The phosphated samples were finally rinsed in cold tap water and dried in a low temperature oven.

Figure 5A:
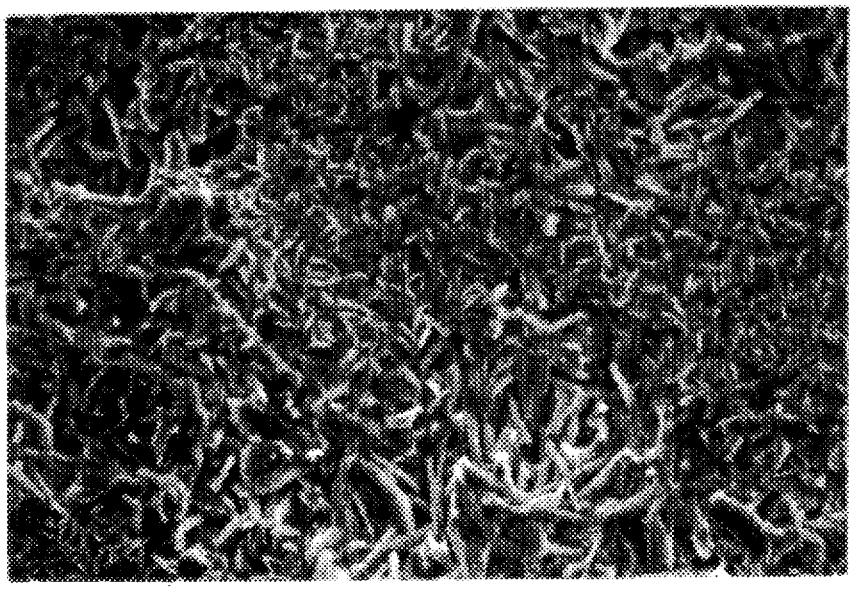
FIGS. 5*a*–5*d* are photomicrographs and EDS spectra photographs showing phosphated test samples.
Figure 5B:
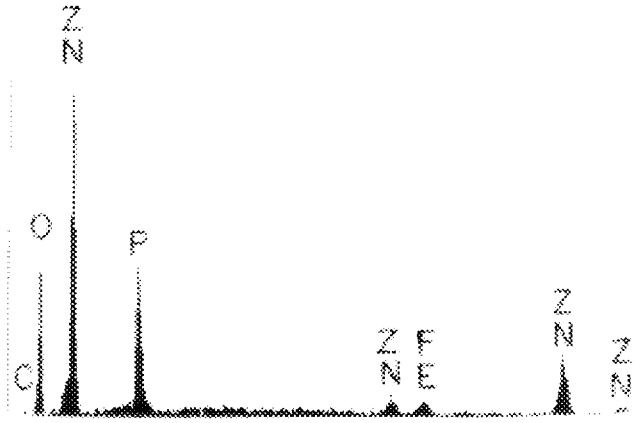
Figure 5C:
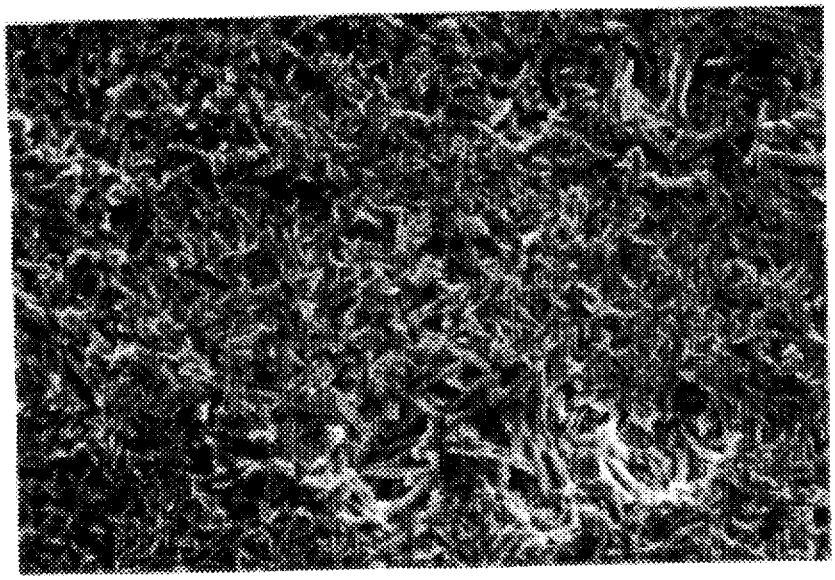
Figure 5D:
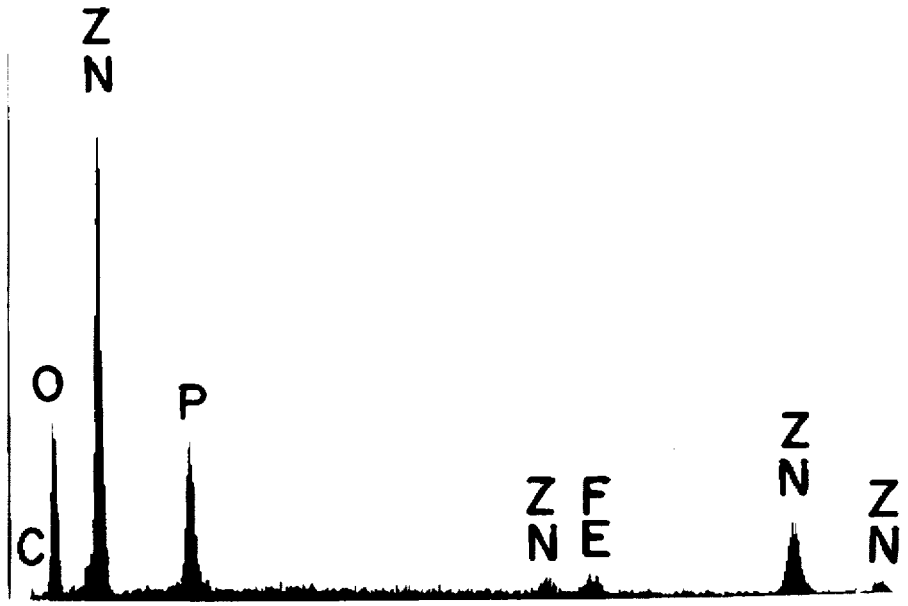

FIG. 5a shows the surface morphology of a galvanneal control sample that did not receive an oxalate spray treatment prior to being phosphated, and FIG. 5b shows the EDS spectrum for a phosphated galvanneal control sample. Similarly, FIG. 5c shows the surface morphology for phosphated galvanneal that received an oxalate spray treatment prior to phosphating, and FIG. 5d shows the EDS spectrum for phosphated galvanneal that was oxalate spray treated prior to a phosphating step. Cleaning and phosphatization subsequent to oxalation produces phosphate morphology and coating weights that were essentially the same as the phosphate morphology and phosphate weights obtained on the untreated galvanneal control material. Phosphating weights on the control material were about 3.3 g/m$^2$, and phosphate coating weights subsequent to oxalation were about 3.5 g/m$^2$. The EDS spectrum on FIGS. 5b and 5d also show the phosphate coatings obtained on the control and oxalate treated materials are similar. Therefore, one can conclude that the oxalate process of the present invention improves product formability without adversely affecting subsequent phosphating processes in a manufacturing line.

Oxalate spray treated galvanneal panels were tested for weldability. The welding tests were conducted on galvanneal test samples that received an alkaline cleaner pretreatment followed by a 2 second oxalate spray treatment, and on galvanneal test samples that received a 5 second oxalate spray treatment without an alkaline cleaner pretreatment. As described earlier, such short oxalate treatments produce thin oxalate film coatings that are absent of a crystallin structure. The tests were conducted in accordance with BSEL-1 electrode life test methods. A weld rate of 30 welds/minute was employed to keep electrode lives shorter than 10,000 welds. The test results are summarized in Table C. Electrode life for oxalate treated galvanneal was excellent and only slightly lower than the electrode life for untreated galvanneal control samples.

TABLE C

| TEST SAMPLE DESCRIPTION | Mean Surface Resistance (micro-ohms) | Electrode Life (No. of Welds) |
|---|---|---|
| Untreated galvanneal control sample | 19 | 10,000 approx. |
| Alkaline cleaning, 2 sec oxalate spray | 151 | 9,200 |
| Only a 5 sec oxalate spray | 66 | 7,800 |

While this invention has been described as having a preferred process, it is understood that it is capable of further modifications, uses and/or adaptations of the invention, following the general principle of the invention and including such departures from the present disclosure as have come within known or customary practice in the art to which the invention pertains, and as may be applied to the central features hereinbefore set forth, and fall within the scope of the invention of the limits of the appended claims.

I claim:

1. A method for improving the formability of zinc coated steel sheet or strip on which a zinc coating has been applied to at least one surface thereof, the steps of the method comprising:

a) applying to the zinc coating an oxalic acid solution in an amount to form a zinc oxalate film having a coating weight in a range of about 10 mg/ft to about 200 mg/ft$^2$;

b) applying to said zinc oxalate film a lubricant adsorbed by said zinc oxalate film to obtain a lubricated zinc oxalate film bonded to the zinc coating; and c) forming the zinc coated steel sheet or strip into a finished product shape.

2. The method according to claim 1 wherein the zinc coated steel sheet or strip having said lubricated zinc oxalate film bonded to the zinc coating thereof has improved formability when measured in limiting dome height values, said zinc coated steel sheet or strip having between about 6% to about 10% improvement in limiting dome height value relative to a limiting dome height value measured in a zinc coated steel sheet or strip not having said zinc oxalate film bonded to the zinc coating thereof.

3. The method according to claim 1 wherein the zinc coated steel sheet or strip having said lubricated zinc oxalate film bonded to the zinc coating thereof has a reduced coefficient of friction measured in coefficient of friction values, said zinc coated steel sheet or strip having a reduced coefficient of friction value within a range of about 21% to about 31% reduction relative to a coefficient of friction value measured in a zinc coated steel sheet or strip not having said zinc oxalate film bonded to the zinc coating thereof.

4. The method of claim 1 wherein said oxalic acid solution comprises about 10 g/l oxalic acid to about 3.3 g/l hydrogen peroxide.

5. The method according to claim 1 wherein the zinc coating is cleaned with an alkaline solution prior to the step applying to the zinc coating said oxalic acid solution.

6. The method according to claim 5 wherein the zinc coating is rinsed to remove residual alkaline solution prior to the step applying to the zinc coating said oxalic acid solution.

7. The method of claim 1 wherein the step (c) forming the zinc coated steel sheet or strip into a finished product shape is followed by steps;

d) cleaning the finished product shape with an alkaline solution to remove said lubricated zinc oxalate film bonded to the zinc coating, and e) applying to the zinc coating a phosphate coating to provide a base for paint.

8. The method according to claim 1 wherein the zinc coating is galvanneal.

9. A zinc coated steel sheet or strip on which a zinc coating has been applied to at least one surface thereof comprising:

a) a lubricated zinc oxalate film bonded to the zinc coating, said lubricated zinc oxalate film having a coating weight in a range of about 10 mg/ft$^2$ to about 200 mg/ft$^2$, said lubricated zinc oxalate film bonded to the zinc coating providing a zinc coated sheet or strip having:

i) improved formability measured in limiting dome height values relative to a limiting dome height value measured in an untreated zinc coated steel sheet or strip not having said zinc oxalate film bonded to the zinc coating thereof, and ii) a reduced coefficient of friction relative to a coefficient of friction value measured in the untreated zinc coated steel sheet or strip.

10. The zinc coated steel sheet or strip of claim 9 wherein said improved formability is within a range of about 6% to about 10% improvement relative to the limiting dome height value measured in the untreated zinc coated steel sheet or strip.

11. The zinc coated steel sheet or strip of claim 9 wherein said reduced coefficient of friction is within a range of about a 21% to about 31% reduction relative to the coefficient of friction value measured in the untreated zinc coated steel sheet or strip.

12. The zinc coated steel sheet or strip of claim 9 where the zinc coating is galvanneal.

13. The method according to claim 1 wherein the zinc coated steel sheet or strip having said lubricated zinc oxalate film bonded to the zinc coating thereof has improved formability measured in a limiting dome height value, said zinc coated steel sheet havinig up to about a 10% improvement in limiting dome height value relative to a limiting dome height value measured in a zinc coated steel sheet or strip not having said zinc oxalate film bonded to the zinc coating thereof.

14. The method according to claim 9 wherein said improved formability is up to about 10% improvement in limiting dome height value relative to the limiting dome height value measured in the untreated zinc coated steel sheet or strip.

15. A zinc coated steel sheet or strip product having improved formability, the zinc coated steel sheet or strip having a zinc coating applied to at least one surface thereof and comprising:

a) a zinc oxalate film bonded to the zinc coating applied to at least one surface of the steel sheet or strip, said zinc oxalate film having a coating weight in a range of about 10 $mg/ft^2$ to about 200 $mg/ft^2$, and said zinc oxalate film providing up to about 10% improvement in formability measured in limiting dome height value relative to the limiting dome height value measured in a zinc coated steel sheet or strip not having said zinc oxalate film bonded to the zinc coating thereof.

16. The product recited in claim 15 wherein said zinc oxalate film is lubricated.

17. The product recited in claim 15 wherein the zinc coated steel sheet or strip is galvannealed.

18. The product recited in claim 17 wherein said zinc oxalate film is lubricated.

* * * * *